US006276788B1

(12) United States Patent
Hilton

(10) Patent No.: US 6,276,788 B1
(45) Date of Patent: Aug. 21, 2001

(54) INK CARTRIDGE FOR AN INK JET PRINTER HAVING QUICK DISCONNECT VALVE 09

(75) Inventor: Brian S. Hilton, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/270,464

(22) Filed: Mar. 15, 1999

Related U.S. Application Data

(60) Provisional application No. 60/113,897, filed on Dec. 28, 1998.

(51) Int. Cl.[7] ..... B41J 2/175
(52) U.S. Cl. ..... 347/86
(58) Field of Search ..... 347/84, 85, 86, 347/87, 49

(56) References Cited

U.S. PATENT DOCUMENTS

| | | | |
|---|---|---|---|
| 5,138,332 | 8/1992 | Carlotta | 347/92 |
| 5,159,348 | 10/1992 | Dietl et al. | 347/89 |
| 5,519,425 | 5/1996 | Dietl et ql. | 347/87 |
| 5,988,802 * | 11/1999 | Pawlowski et al. | 347/86 |
| 5,992,987 * | 11/1999 | Childers et al. | 347/85 |

* cited by examiner

*Primary Examiner*—N. Le
*Assistant Examiner*—Michael Nghiem
(74) *Attorney, Agent, or Firm*—David J. Arthur

(57) ABSTRACT

An ink jet cartridge has a rigid housing with a flexible, vent-free pouch containing ink positioned therein. The pouch has a fitment sealed therein with a quick disconnect valve incorporated in the distal end of the fitment which extends from the pouch. The housing protects the ink pouch from handling forces and provides the device to apply an insertion force necessary to install a cartridge into an ink supply station of an ink jet printer. Ink is extracted by a probe resident in the ink supply station which actuates the quick disconnect valve upon insertion of the cartridge. The quick disconnect valve reseals when the cartridge is removed from the probe. The quick disconnect valve has a spring biased ball and a resilient cap releasably snapped on the valve which has an internal conical wall that functions as a valve seat for the spring biased ball. The valve configuration reduces the number of parts and provides a larger and better surface for the ball to seal against.

10 Claims, 6 Drawing Sheets

INK CARTRIDGE FOR AN INK JET PRINTER HAVING QUICK DISCONNECT VALVE 09

Priority is claimed to Provisional Patent Application Ser. No. 60/113,897, filed on Dec. 28, 1998.

BACKGROUND OF THE INVENTION

The present invention relates to droplet-on-demand ink jet printing systems, and more particularly to replaceable ink supplies for multicolor ink jet printers which have a quick disconnect valve that enables insertion and removal in the printer without loss of ink thereby preventing printer contamination.

Current ink jet products have ink tanks with ink volumes less than 25 ml. As the ink jet market moves towards larger monthly print volumes and faster speeds, a high capacity, 'off-carriage' ink tank is necessitated. Such a high capacity ink tank cannot afford to provide added volume for foams and felt which carry ink as many of the current products do. These foams and felts also provide means to keep the installation and replacement of spent cartridges from leaking ink and causing contamination of the printers or soiling the hands of the user. This lack of ink leakage or spillage during the handling of the cartridges is sometimes referred to as a 'white glove' insertion and removal operation and of course is very desirable.

U.S. Pat. No. 5,159,348 discloses an ink jet printer having a printhead assembly comprising a printhead and ink reservoir mounted on a scanning carriage for movement across a recording medium with an off carriage ink supply in the form of a flexible bag to replenish the ink used from the ink reservoir. Supply lines interconnect the ink supply with the ink reservoir. A pump is provided in the supply line for activation only during a priming operation.

U.S. Pat. No. 5,138,332 discloses an ink jet printer assembly comprising a printhead and ink reservoir mounted on a scanning carriage for movement across a recording medium. An off carriage ink supply bag is connected to the ink reservoir by tubing. The reservoir is arranged so that pressure applied to the ink supply bag forces ink into the reservoir and any air in the reservoir is expelled through the printhead nozzles, thereby priming both the printhead and the reservoir without the need for a vent in the reservoir.

U.S. Pat. No. 5,519,425 discloses an ink jet cartridge mounted on a scanning carriage for movement across a recording medium. The cartridge includes a printhead which is integrally fixed to an ink reservoir containing the typical absorbent material to hold the ink. One purpose of the absorbent material is to prevent sloshing of the ink in the reservoir during the back and forth scanning of the of the cartridge. This cartridge has a film member which completes the passageway between the reservoir and the printhead and concurrently provides the fluid seal between them and the means to adhere the printhead to the reservoir.

Most known ball valve connectors use a fitment with external threads which houses the ball and spring and a separate elastomeric washer as a valve seat. The ball valve connector uses a screw on cap with a centrally located aperture to fasten the connector together. The spring urges the ball against the washer to seal the cap aperture as illustrated in FIG. 1, discussed later, such as currently used in the fuser oil supply of the Xerox 4900 laser printer. A fixed probe in the 4900 machine moves the ball away from the elastomeric washer to enable fuser oil to be removed from the oil supply tank.

Other ink jet products utilize a flexible ink supply pouch with a sealed fitment, but the interconnection is by needle and septum and not by a spring loaded ball quick disconnect valve wherein the entire valve is sealed into the flexible pouch.

SUMMARY OF THE INVENTION

It is an object of the present invention to provide a customer replaceable ink cartridge having a vent-free flexible pouch with a quick disconnect valve sealed into the pouch and a rigid housing to contain the pouch in a predetermined location therein which protects the flexible pouch from handling forces.

In one aspect of the invention, there is provided a customer replaceable ink cartridge for an ink supply station of an ink jet printer, the ink supply station having at least one fixedly mounted probe for releasable connection with the cartridge, the cartridge comprising: a vent-free flexible pouch containing ink; a fitment integrally attached to the pouch and having an end which extends therefrom; and a quick disconnect valve provided on the end of the fitment, said valve having a movable ball located therein and an aperture adapted for the insertion of said probe, the aperture being surrounded by an internal valve seat and the ball being resiliently urged against the valve seat to close the aperture, so that ink flows from the pouch only when said ball is moved from the valve seat by said probe.

In one embodiment of the invention, there is provided a customer replaceable ink cartridge for an ink jet printer having an ink supply station for receipt of one or more ink cartridges, comprising: a vent-free flexible pouch having an opening therein; a fitment having opposing first and second ends, the first end being sealed into the pouch opening to provide a flow path for ink into and out of the pouch, said first end of the fitment which is sealed into the pouch opening preventing collapse of the pouch in the vicinity of the fitment, the fitment having an internal projection and an external protrusion at the opposing second end; a spring being inserted into the second end of the fitment to reside against the internal projection; a ball being located on said spring, so that said spring urges the ball in a direction away from the fitment; a releasable integral valve seat and cover having an aperture therein, the valve seat and cover being mounted on the second end of the fitment and held in place by the external protrusion, the valve seat being conical and having the aperture located therethrough, the valve seat confronting the ball, so that the spring urges the ball against the valve seat and seals off the aperture to provide a quick disconnect valve; a collar mounted on the second fitment end and having a shape to aid in subsequent assembly; and a rigid housing for containment of the pouch, fitment, and quick disconnect valve, the housing having a receptacle to receive the collar and enable alignment of the pouch, fitment, and quick disconnect valve therein, the housing having a key representative of a color, so that the cartridge must be inserted into the ink supply station in a specific location which has been allocated for the color of ink in the cartridge.

BRIEF DESCRIPTION OF THE DRAWINGS

The present invention will now be described by way of example with reference to the accompanying drawings, in which like reference numerals refer to like elements, and in which.

DESCRIPTION OF THE PREFERRED EMBODIMENT

Figure 1:
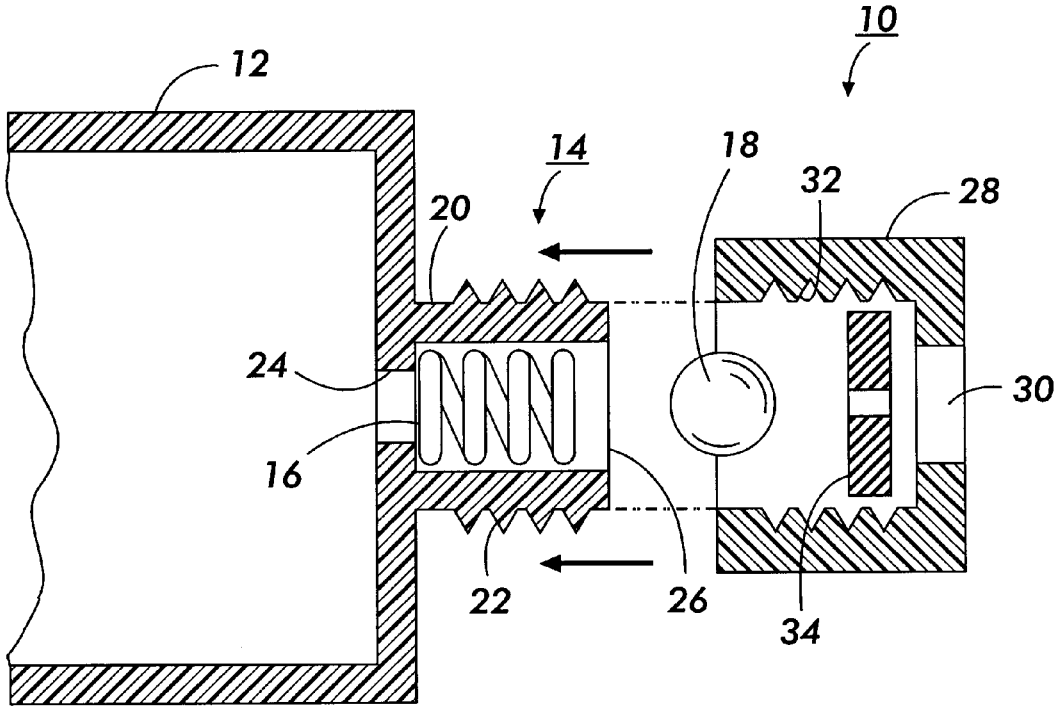
FIG. 1 PRIOR ART
FIG. 1 is an exploded, cross sectional view of a known ball valve connector.

In FIG. 1, an exploded, cross sectional view of a known ball and spring type valve connector 10 is shown integrally attached to a bottle 12. The valve connector 10 comprises a fitment 14 housing the spring 16 and ball 18. The fitment 14 has sleeve portion 20 with external threads 22. A portion of the sleeve adjacent the pouch has an internal shoulder 24 and an opposing open end 26 for installation of the spring 16 onto the internal shoulder 24. The ball 18 is located on the end of the spring 16 adjacent the sleeve open end. A cylindrical cap 28 with a centrally located aperture 30 has internal threads 32 adapted to screw onto the external threads 22 of the fitment's sleeve portion 20. A washer 34 having an opening therethrough with an internal diameter smaller than that of the cap aperture resides in the cap, thereby reducing the opening of the aperture and serving as a valve seat for the ball which is urged into washer opening by the spring 16. The diameter of the ball is larger than the cap aperture, so that the ball acts as a one way valve and keeps the contents of the bottle 12 from exiting the cap aperture 30. The contents of the bottle can only be removed when a probe (not shown) is inserted into the cap aperture and physically moves the ball away from the valve seat in a direction towards the internal shoulder of the sleeve by overcoming the force of the spring.

Figure 2:
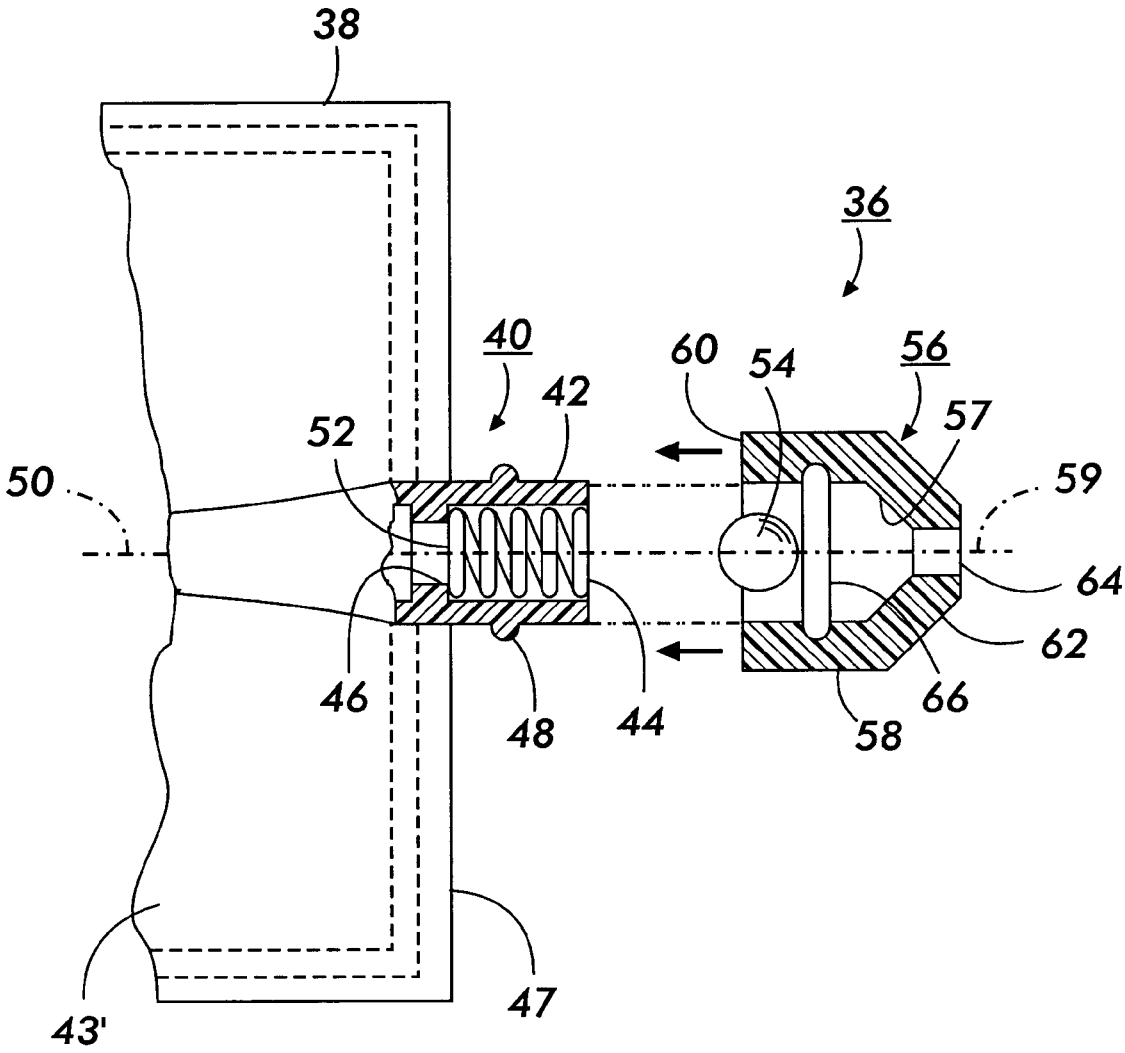
FIG. 2 is an exploded, cross sectional view of the quick disconnect valve of the present invention.

An exploded, cross sectional view of the quick disconnect valve 36 of the present invention is shown in FIG. 2, sealed into a partially shown flexible pouch 38. The quick disconnect valve 36 comprises a fitment 40 having a sleeve like portion 42 extending from the pouch. The sleeve portion has an open end 44, an internal shoulder 46, and an external annular protrusion 48 which is perpendicular to the axis 50 of the sleeve. A cylindrical, stainless steel spring 52 is located internally of the sleeve and in contact with the internal shoulder 46, and a stainless steel ball 54 is positioned on the end of the spring adjacent the sleeve open end 44. A resilient, elastomeric cap 56 has a substantially cylindrical portion 58 with an open end 60 and a closed end 62 in the shape of a frustum of a cone. The cylindrical portion of the cap has a cylindrically shaped internal cavity and the conical portion of the cap has a conically shaped internal cavity contiguous with the cylindrical cavity. The frustum of a cone portion of the cap has an aperture 64. The internal conical cavity wall 57 functions as a valve seat for the ball 54. The cap 56 has an axis 59 and an annular internal recess 66 located in the cylindrical portion of the cap. The annular internal recess is perpendicular to the axis of the cap. The cap aperture 64 is centrally located and has a diameter smaller than the diameter of the ball 54. The resilient cap 56 is dimensioned so that it may deform or stretch when installed over the annular protrusion 48 of the fitment sleeve portion and relaxes to its normal shape when the annular internal recess 66 receives the annular protrusion 48 of the sleeve portion of the fitment 40. When installed on the sleeve portion of the fitment 40, the cap is fastened thereto with its axis 59 coincident with the axis 50 of the fitment sleeve portion. The force of the spring 52 urges the ball 54 against the valve seat of the cap, so that the spring-biased ball acts as a one way valve and keeps the contents of the pouch 38 from exiting the cap aperture 64. The contents of the pouch can only be removed when a probe 68 (FIG. 4) is inserted into the cap aperture and physically moves the ball away from the valve seat by overcoming the force of the spring 52.

Figure 3:
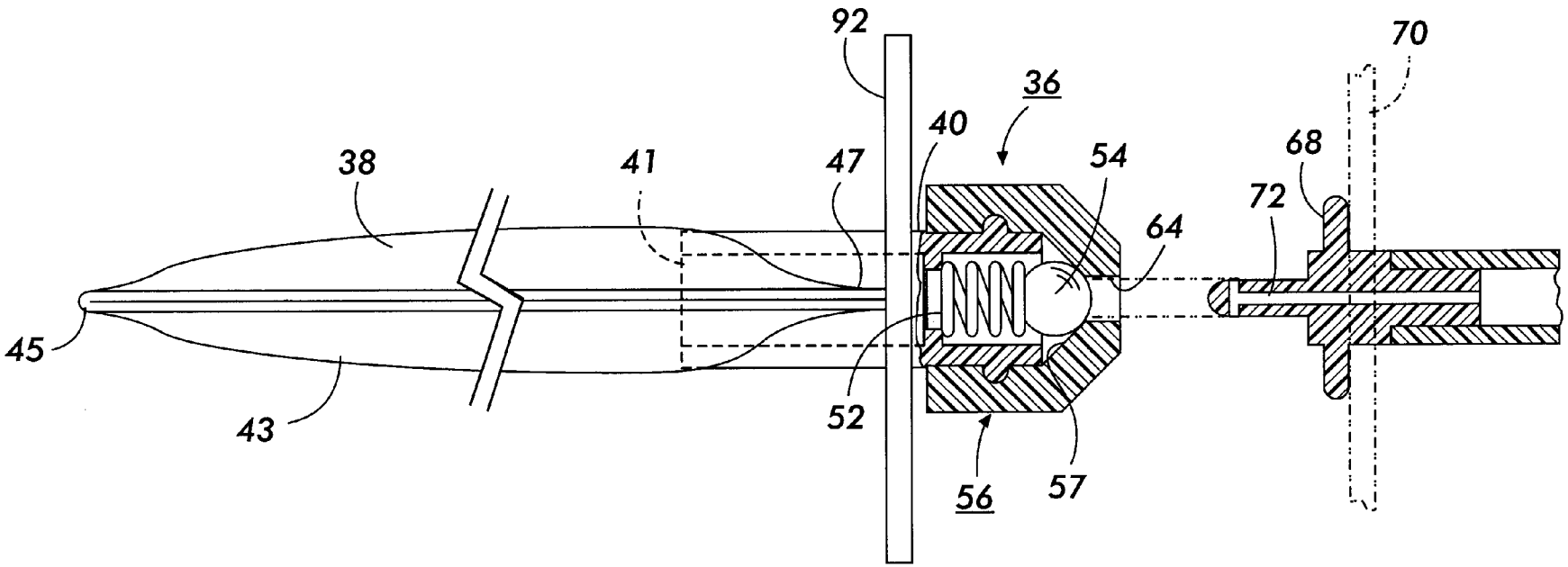
FIG. 3 is a partially sectioned side view of the flexible pouch and sealed fitment with integral quick disconnect valve shown prior to installation in the ink jet printer.
Figure 4:
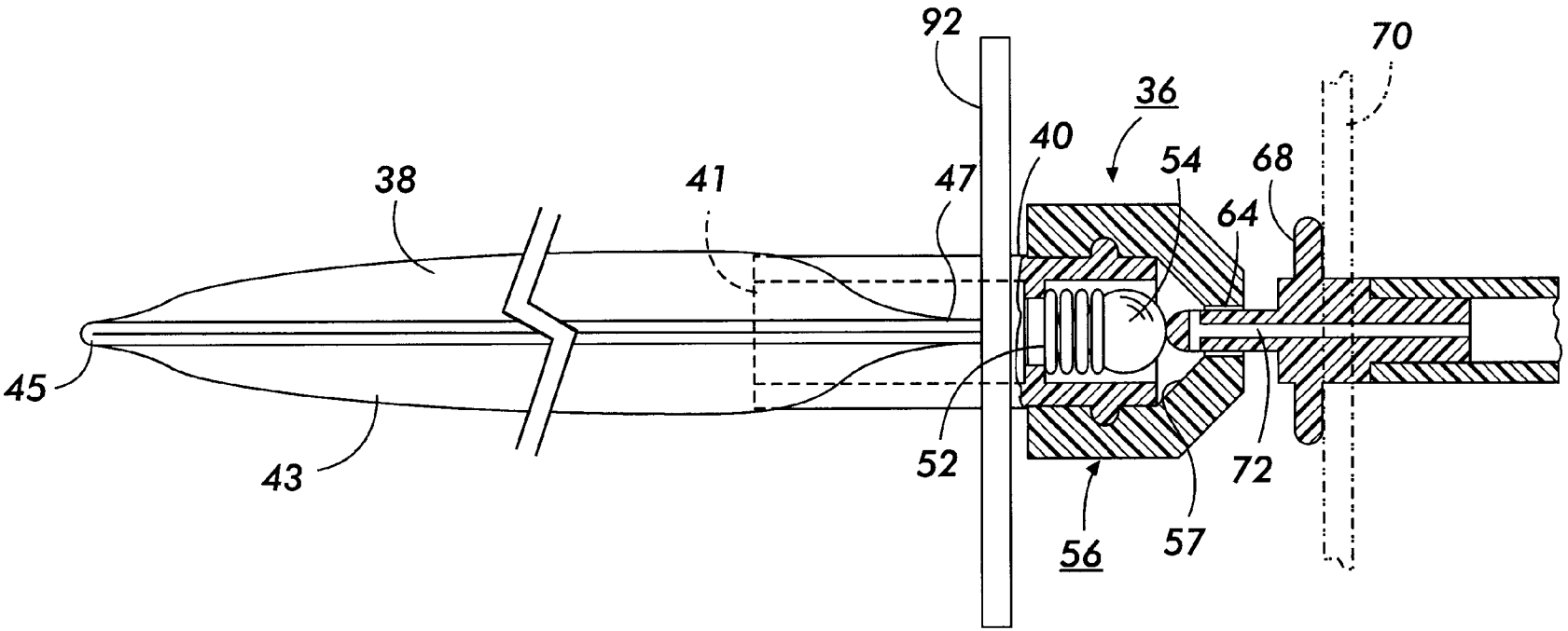
FIG. 4 is a partially sectioned side view of the flexible pouch and sealed fitment with integral quick disconnect valve shown after installation in the ink jet printer.

A side view of the pouch, fitment, and quick disconnect valve is shown assembled together and partially sectioned in FIGS. 3 and 4. The probe 68 is shown in cross section and fixedly attached to a frame member 70, shown in dashed line. The frame member is a component of the ink supply station of the ink jet printer, discussed later. The rigid housing (FIG. 5) of the replaceable ink cartridge that contains the pouch 38, fitment 40, and quick disconnect valve 36 shown assembled together as assembly 39 has been omitted in FIGS. 3 and 4 for ease of describing the actuation of the quick disconnect valve 36 by the probe and will also be discussed later. FIG. 3 shows the quick disconnect valve 36 in the closed state with the spring-biased ball 54 against the valve seat 57 and the probe 68 spaced from the valve. FIG. 4 shows the probe 68 inserted through the aperture 64 in the cap 56 of the quick disconnect valve, so that the spring-biased ball is moved from its valve seat 57. In this state, the ink in the pouch can exit the valve and flow into the T-shaped passageway 72 in the probe for continued travel to the ink jet printhead (not shown).

Figure 5:
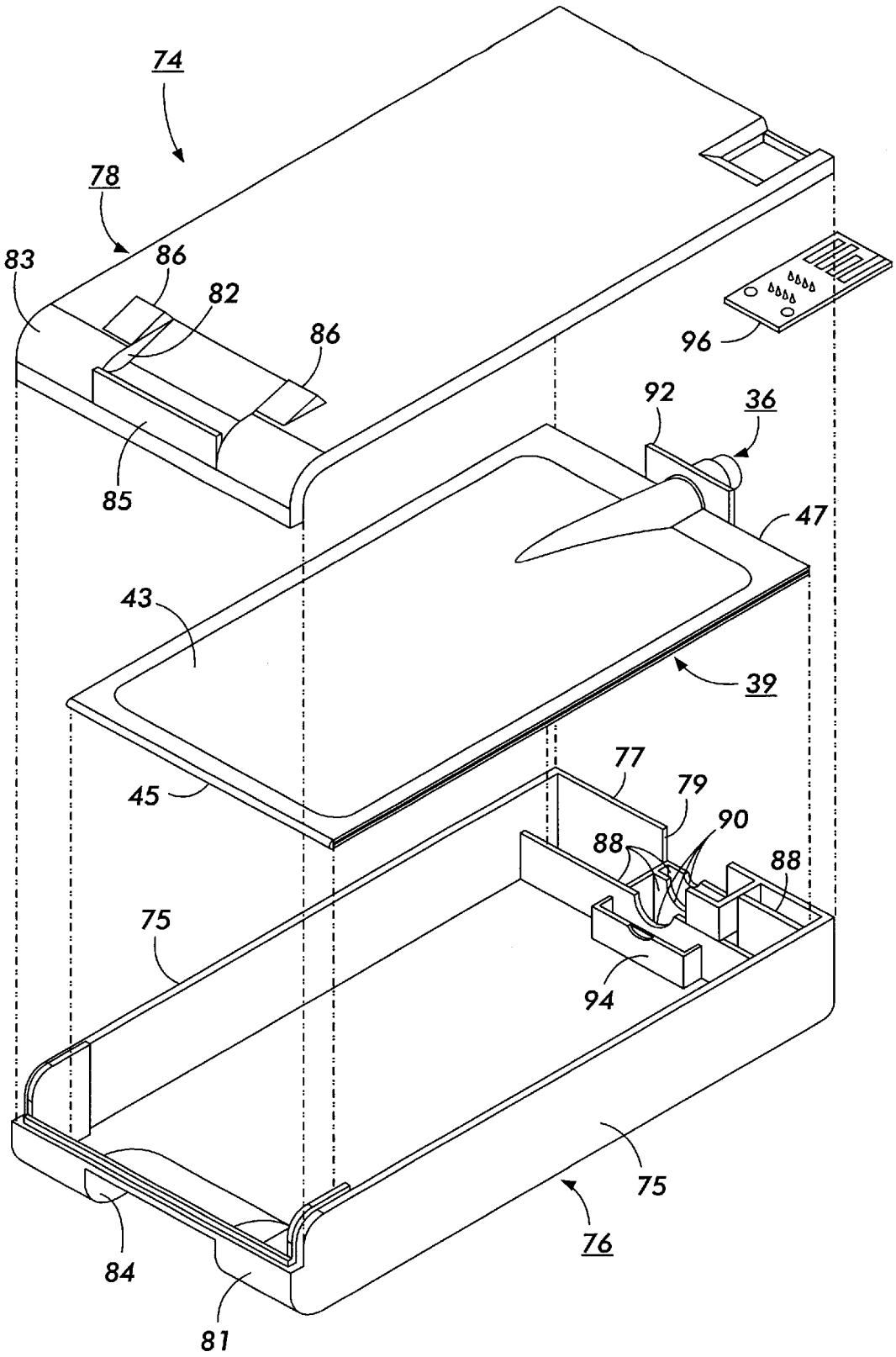
FIG. 5 is an exploded, isometric view of the ink cartridge of the present invention.

Referring to FIG. 5, the ink cartridge 74 is shown in an exploded, isometric view. The cartridge is composed of a rigid bottom unit 76 and a rigid top cover 78, which are sonically welded together after precise placement of the flexible ink pouch assembly 39 into the cartridge bottom unit. Referring also to FIG. 3, the pouch assembly includes the flexible pouch 38 and fitment 40 with quick disconnect valve 36. The pouch design is a simple pillow configuration without a vent and was chosen for its ease of manufacture, low cost, and filling with ink. A sheet or web of film 43 of any suitable ink compatible polymeric material, such as, for example, a polyester material such as Mylar®, is folded in half, so that the fold will be at the bottom 45 of the subsequently formed pouch. The other sides of the film are sealed by heat or any suitable, ink compatible adhesive with the fitment being sealed into the top side 47 of the pouch opposite the folded side.

In the preferred embodiment, a 48 gauge metalized polyester material is laminated to a 2 mil or 50 micrometer thick polyethylene inner liner (neither shown). The inner liner or layer provides the ink compatibility and accommodates the seam sealing. The seams on the three sides of the pouch are hot melted together and no volatile solvents are used. The metalized polyester material provides the strength and low moisture vapor transfer rate and, because it is vent free, this construction and material allows a long shelf life. The laminate 43' (FIG. 2) of metalized polyester material and polyethylene inner layer is flexible, so that the ink placed therein can be withdrawn with a low pressure differential that is suitable for ink jet printers. The use of a multi-layer plastic film 43' reduces the package cost compared to multi-purpose, high performance material which is typically extremely expensive and difficult to make. The metalized polyester layer (not shown) provides an added barrier to air and makes the pouch opaque. Importantly, the laminated pouch is still recyclable. The fitment is an ejection molded device that is either heat staked into the seam of the pouch top side 47 or is staked into the pouch material prior to the folding and formation of the pouch. The fitment enables the pouch to be filled with ink prior to installation of the spring, ball, and cap. The portion of the fitment residing inside the pouch prevents the pouch from collapsing at the entrance end 41 (FIGS. 3 and 4) of the fitment and impeding the removal of ink during use as an ink supply in the printer. As volume requirements increase, the flexible pouch may be provided with internal gussets (not shown) to aid in extraction of ink.

The ink cartridge 74 is a customer replaceable unit and is designed to protect the flexible pouch 38 from handling forces, as well as provide the means for the customer to apply the necessary insertion force when installing the cartridge in an ink supply station 80 (FIG. 6) of a printer. The cartridge enables a customer to extract and reinstall the same cartridge or replace an ink-depleted cartridge with a new one without any ink leakage or spillage. This prevention of ink leakage or spillage which would contaminate the ink jet printer and soil the hands of the customer is sometimes referred to as a "white glove" operation and is a goal not always achieved by prior art devices. The cartridge is molded from any suitable plastic material, but in the preferred embodiment is molded from polystyrene and reclaimed polystyrene may be used. The cartridge is designed to restrict the customer from forcing ink out of the pouch while the pouch is connected to the ink supply station or otherwise in communication with the printer. As mentioned above, the cartridge also provides the rigid container and surfaces for the application of the insertion force necessary to install the ink cartridge into the ink supply station of the printer whereat the fixedly mounted probe is positioned.

As shown in FIG. 5, the bottom unit 76 of the ink cartridge 74 is a molded integral unit having vertical upstanding walls. The bottom unit has two substantially parallel side walls 75, a top wall 77 with a cutout 79 to accommodate the quick disconnect valve 36, and a bottom wall 81 with a portion opposite the top wall 77 which is arcuate in shape with lesser height than the other walls. The top cover 78 is substantially flat, but has a matching arcuate shape portion at one end 83 to form a rounded surrounding end to the cartridge when the top cover is attached to the bottom unit. The rounded or arcuately shaped portion or wall on the respective top cover and bottom unit each have centrally located recesses 82 and 84, respectively, to form a location for use in manual handling and the manual insertion and extraction of the ink cartridge into and from the printer's ink supply station. The recess 82 in the top cover has an upstanding lip 85 to further assist inserting and withdrawing the cartridge from the printer. A pair of stops 86 are located on opposite sides of the recess 82 in the top cover 78 to prevent the application of too much force on the quick disconnect valve 36 and probe 68 by the customer, when the stops 86 come into contact with the rib 108 (FIG. 6) of the ink supply station 80.

In the bottom unit 76 and in the vicinity of the bottom unit's top wall 77 are several interior walls 88 for structural strengthening of the cartridge. These interior walls have cutouts 90 to receive and locate the pouch fitment 40 and integral quick disconnect valve 36. A relatively thin flat collar 92 that may be any shape, but in the preferred embodiment is rectangular, is attached to the fitment adjacent to the flexible pouch. The collar 92 is substantially perpendicular to the axis 50 of the fitment 40 and is used to precisely align and locate the pouch assembly in the cartridge bottom unit 76 prior to the attachment of the top cover 78. A special receptacle 94 is formed in the bottom unit adjacent the interior walls 88 and is adapted to accept the pouch assembly collar in a specific orientation, so that the insertion of the collar in the receptacle precisely aligns the pouch assembly. When the top cover 78 is attached to the bottom unit 76, the pouch assembly 39 is locked into position.

The ink cartridge 74 has a customer replaceable unit management system in the form of an EEPROM 96 that includes a counter and a memory (neither shown) to retain counting data representative of cumulative ink output of the cartridge. The ink droplet volume per droplet fired by a thermal ink jet device is controlled at tight tolerances to meet the required print quality. This droplet volume is well understood for the different inks and print resolutions of the printer using the ink cartridge 74. Accordingly, the droplets or pixels fired have precise volumes and the count thereof by the counter provides the amount of ink used. The memory is accessed by the printer to determine the amount of ink left in the cartridge and generates a signal representative thereof. This signal is sent to a fuel gauge (not shown) in the printer's display panel (not shown) to inform the customer of the amount of ink remaining in the ink cartridge.

Figure 6:
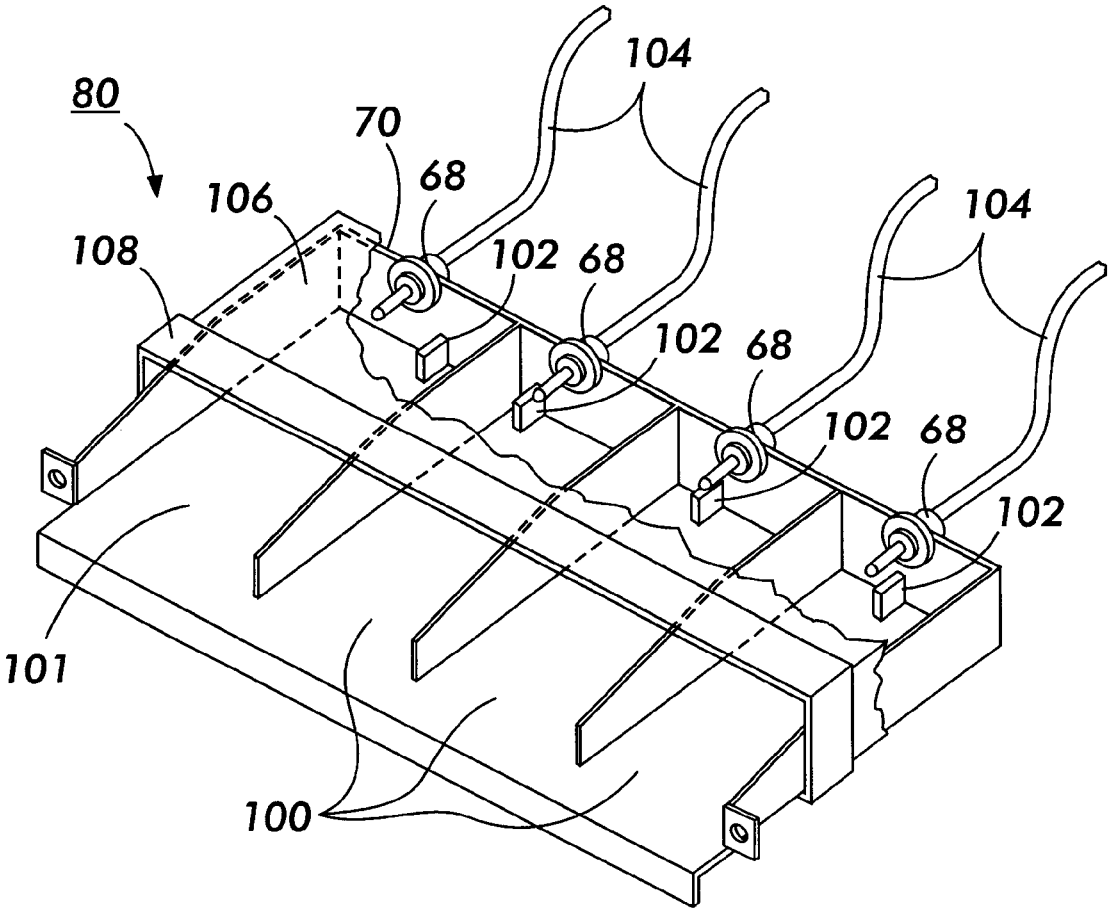
FIG. 6 is a schematic isometric view of the ink supply station of the ink jet printer into which the ink cartridge is installed.

For a multicolor ink jet printer using four different colors of ink, an ink supply station 80 having four separate receptacles 100, 101 for receiving four different ink cartridges, each containing a different color of ink, is shown in FIG. 6. Because more black ink is used than the other colors, a larger ink cartridge is generally used for this color of ink and the ink supply station has a larger receptacle 101 to accommodate the larger cartridge. To prevent the inadvertent installation of a cartridge with the wrong color of ink in the wrong receptacle of the ink supply station, each cartridge has means to enable insertion into only the correct receptacle. In one embodiment of the invention, specific keyways (not shown) are provided in each cartridge for a specific color, and likewise specific keys 102 are provided in each receptacle which match only the keyway of the cartridge with the correct color. In FIG. 6, the keys are the same except for their locations and each cartridge has a keyway location according to the color of ink contained in its flexible pouch. However, the keys and associated keyways could be different in shape. Each supply station receptacle has a fixedly mounted probe 68, so that the installation of an ink cartridge full into the receptacle automatically causes the probe to enter the aperture 64 of the cap 56 in the respective quick disconnect valve 36 of the cartridge 74. Tubing 104 attached to each probe 68 connects to the printhead or each printhead portion for each allocated color. The top wall 106 of the ink supply station has a reinforcing rib 108 which is engaged by the stops 86 on the cartridges to prevent the application of too much force by the customer when the cartridges are installed.

Although the foregoing description illustrates the preferred embodiment, other variations are possible, and all such variations as will be apparent to those skilled in the art are intended to be included within the scope of this invention as defined by the following claims.

What is claimed is:

1. A customer replaceable ink cartridge for an ink supply station of an ink jet printer, the ink supply station includes at least one fixedly mounted probe for releasable connection with the cartridge, the cartridge comprising:

a vent-free flexible pouch suitable for containing ink; a fitment integrally attached to the pouch and having an end extending therefrom; and a quick disconnect valve an the end of the fitment, the valve comprising:

a resilient cap having an interior surface, an exterior surface, and an aperture through the cap, wherein the interior surface of the cap surrounding the aperture forms a valve seat; and a movable ball resiliently urged against the valve seat to close the aperture;

wherein the fitment includes an internal shoulder, and the quick disconnect valve additionally comprises a spring that resides against the internal shoulder of the fitment and urges the movable ball against the valve seat; and wherein the resilient cap is held in place by frictional engagement with the fitment extending from the pouch.

2. The ink cartridge of claim 1, wherein:

the fitment includes an external protrusion; and the resilient cap includes an internal recess adapted to engage the external protrusion of the fitment.

3. The ink cartridge of claim 2, wherein:

the external protrusion of the fitment includes an annular protrusion; and the internal recess of the cap includes an annular recess.

4. The ink cartridge of claim 1, wherein the interior surface of the resilient cap surrounding the aperture is substantially conical in shape.

5. The ink cartridge of claim 4, additionally comprising a rigid housing surrounding the flexible pouch, wherein the fitment and quick disconnect valve extend from the rigid housing.

6. A customer replaceable ink cartridge for an ink jet printer including an ink supply station for receiving of one or more ink cartridges, the ink cartridge comprising:

a vent-free flexible pouch including an opening therein;

a fitment having first and second ends, the first end being sealed into the pouch opening to provide a flow path for ink into and out of the pouch, said first end of the fitment which is sealed into the pouch opening preventing collapse of the pouch in the vicinity of the fitment, the fitment including an internal projection;

a quick disconnect valve comprising:

a spring being inserted into the second end of the fitment to reside against the internal projection;

a ball being located on the spring, so that the spring urges the ball in a direction away from the fitment;

a releasable integral valve seat and cover having an aperture therethrough, the valve seat and cover being mounted on the second end of the fitment and held in place by a friction fit between the fitment and the integral valve seat and cover;

an external collar mounted on the second fitment end; and a rigid housing for containing the pouch, fitment, and quick disconnect valve, the housing including a receptacle to receive the collar.

7. The cartridge as claimed in claim 6, wherein the ink supply station of the printer includes a fixed probe that enters the aperture of the valve seat and cover when the cartridge is installed therein to provide access to the ink in said cartridge by the probe dislocating the ball from the valve seat, thereby allowing ink to flow through the quick disconnect valve.

8. A method of assembling a customer replaceable ink cartridge, the method comprising:

providing a vent-free flexible pouch having a fitment having first and second ends, wherein the first end is sealed into the pouch to provide a fluid flow path into and out of the pouch;

placing a resilient member against a portion of the fitment;

placing a ball against the resilient member;

engaging over the second end of the fitment an integral valve seat and cover having an aperture therethrough so that the resilient member urges the ball against the interior surface of the integral valve seat and cover around the aperture, wherein the step of engaging the integral valve seat and cover over the second end of the fitment comprises frictionally engaging the integral valve seat and cover over the second end of the fitment, said integral valve seat and cover being held in place by frictional engagement with the second end of the fitment.

9. The method of claim 8, wherein:

the step of providing a vent free flexible pouch includes providing on the fitment an external annular protrusion; and the step of frictionally engaging the integral valve seat and cover additionally comprises providing the integral valve seat and cover with an internal annular recess, and engaging the external annular protrusion of the fitment and the internal annular recess of the integral valve seat and cover.

10. The method of claim 8, additionally comprising the step of containing the flexible pouch in a rigid housing so that the second end of the fitment extends from the rigid housing.

* * * * *